United States Patent [19]

Phillips

[11] Patent Number: 4,510,636

[45] Date of Patent: Apr. 16, 1985

[54] SYSTEM AND METHOD FOR FORMING CUSTOM-MADE SHOE INSERTS

[75] Inventor: Edward H. Phillips, Middletown, Calif.

[73] Assignee: Amfit Incorporated, Sunnyvale, Calif.

[21] Appl. No.: 286,244

[22] Filed: Jul. 23, 1981

[51] Int. Cl.[3] ..... A43B 7/14; A43B 13/38; A43D 1/02; C14B 1/44

[52] U.S. Cl. ..... 12/1 R; 12/146 L; 36/93; 69/6.5

[58] Field of Search ..... 12/1 R, 146 L, 142 B, 12/142 BP, 142 BC, 17 R, 31.5; 36/93; 69/6.5

[56] References Cited

U.S. PATENT DOCUMENTS

| | | | |
|---|---|---|---|
| 290,652 | 12/1883 | Sturmer | 12/146 |
| 2,026,620 | 1/1936 | Finn | 12/142 |
| 2,230,143 | 1/1941 | Hyland | 12/60 |
| 2,323,538 | 7/1943 | Hyland | 12/60 |
| 2,958,879 | 11/1960 | James et al. | 12/17 R |
| 2,998,983 | 9/1961 | Digate | 282/1 |
| 3,300,802 | 1/1967 | Polleys | 12/86.6 |
| 3,696,456 | 10/1972 | Dunham et al. | 12/146 L |
| 3,711,880 | 1/1973 | Dalebout | 12/1 R |
| 4,324,118 | 4/1982 | Bruggi | 69/6.5 |

FOREIGN PATENT DOCUMENTS

| | | | |
|---|---|---|---|
| 2715906 | 6/1978 | Fed. Rep. of Germany . | |
| 759013 | 1/1934 | France | 19/1 |
| 761626 | 3/1934 | France | 16/4 |
| 2310845 | 12/1976 | France . | |
| 103168 | 12/1941 | Sweden . | |
| 243835 | 8/1946 | Switzerland . | |

*Primary Examiner*—Werner H. Schroeder
*Assistant Examiner*—Steven N. Meyers
*Attorney, Agent, or Firm*—Roland I. Griffin

[57] ABSTRACT

An automatic system for forming custom-made shoe inserts for a person's feet from a pair of blanks is provided with a foot impression mechanism for simultaneously forming an impression of the contour of the undersurface of each of the person's feet and for releasably retaining each impression formed. The system is also provided with a blank holding assembly for holding the blanks in lateral alignment with the impressions, a blank shaping mechanism for successively sensing each impression and for concomitantly successively cutting material away from each blank in conformance with the corresponding sensed impression, and a drive mechanism for automatically driving the blank shaping mechanism both laterally and to-and-fro over the impressions and the blanks in response to a single drive motor so as to automatically form the custom-made shoe inserts from the blanks in conformance with the impressions.

28 Claims, 14 Drawing Figures

SYSTEM AND METHOD FOR FORMING CUSTOM-MADE SHOE INSERTS

CROSS-REFERENCE TO RELATED APPLICATIONS

The subject matter of this application is related to that of copending U.S. patent application Ser. No. 183,010 entitled SYSTEM AND METHOD FOR FORMING CUSTOM-MADE SHOE INSERT, filed on Sept. 2, 1980, by Donald B. Curchod, issued as U.S. Pat. No. 4,454,618 on June 19, 1984, assigned to the same assignee as the present application, and incorporated herein by reference and to that of copending U.S. patent application Ser. No. 286,245 entitled IMPROVED SYSTEM AND METHOD FOR FORMING CUSTOM-MADE SHOE INSERTS, filed on July 23, 1981, by Vern R. Schwartz, issued as U.S. Pat. No. 4,449,264 on May 22, 1984, and assigned to the same assignee as the present application.

BACKGROUND AND SUMMARY OF THE INVENTION

This invention relates generally to improvements in a system and method for forming custom-made shoe inserts conforming to a person's feet and, more particularly, to an automatic system for forming such custom-made shoe inserts.

A manual system for forming custom-made shoe inserts conforming to a person's feet is disclosed in U.S. patent application Ser. No. 183,010. Each such shoe insert is formed with a contoured foot supporting surface substantially conforming to the contour of the undersurface of the foot for which the shoe insert is formed. This provides better and more comfortable support for the foot than has been heretofore provided by conventional insoles and shoe inserts of standardized contours and sizes.

The manual system disclosed in U.S. patent application Ser. No. 183,010 includes a foot impression mechanism for forming an impression of the contour of the undersurface of a person's foot and a blank shaping mechanism for removing material from a corresponding blank in conformance with that impression to form the shoe insert. The blank shaping mechanism must be manually driven to-and-fro while being manually indexed laterally so as to sense all portions of the impression and remove material from the corresponding blank in conformance with the sensed impression as required to form the shoe insert. Thus, the operator must have a considerable level of skill and perseverance to manually drive and index the blank shaping mechanism as required to faithfully reproduce the impression in the blank and thereby form the shoe insert.

In utilizing the manual system to form a pair of shoe inserts for a person's feet, the operator must first employ the foot impression mechanism to form an impression of the undersurface of one foot and must thereupon manually drive and index the blank shaping mechanism to form the shoe insert for that foot from a corresponding blank. The operator must then employ the foot impression mechanism to form an impression of the contour of the undersurface of the other foot and must thereupon again manually drive and index the blank shaping mechanism to form the shoe insert for that foot from a corresponding blank. This requires constant attention and effort by the operator during each operation of shaping one of the blanks to form one of the shoe inserts, as well as during each operation of forming an impression of the contour of the undersurface of one of the person's feet (hereinafter also referred to as fitting). Thus, the remaining amount of time the operator can spend on selling and other activities is substantially reduced.

The foot impression mechanism employed in the manual system comprises an array of pins arranged in columns and rows, a housing supporting the pins in spaced-apart relationship for vertical movement between retracted and extended positions, a loose-fitting diaphragm for yieldably urging the pins towards their extended positions and into contact with the undersurface of a person's foot to form an impression of the contour thereof, and a locking assembly for thereupon locking the pins in place to retain that impression. Since a loose-fitting diaphragm is employed for urging the pins towards their extended positions, an abrupt vertical transition is formed between the pins contacting the undersurface of the foot and the surrounding pins out of contact with the undersurface of the foot. This abrupt vertical transition tends to impede faithful sensing of the peripheral regions of the impression and, hence, faithful reproduction of those peripheral regions in a corresponding blank. Since the pins are supported in spaced-apart relationship, the surface of the impression itself is not as smooth and continuous as desirable to facilitate faithful sensing of the impression and, hence, reproduction of the impression in a corresponding blank. Moreover, the load-bearing surface area of the impression mechanism is reduced by employing an array of pins supported in spaced-apart relationship. Concomitantly, the unit pressure on the foot is increased resulting in increased distortion of the contour of the undersurface of the foot in soft fleshy areas compared to harder bony areas during the impression forming operation (or fitting).

The locking assembly includes an inflatable tube disposed in serpentine configuration between adjacent pairs of columns of the pins for forcing the pins against the housing to retain the impression of the contour of the undersurface of the foot. Due to high stress factors acting on certain regions of the serpentine-configured inflatable tube, it is somewhat prone to failure. This adversely affects the reliability of the locking assembly and results in more down time of the manual system itself.

The foot impression mechanism and the blank shaping mechanism employed in the manual system disclosed in U.S patent application Ser. No. 183,010 are not as rugged and reliable as might be desired for a system to be used at shoe stores or other point of sale locations by relatively unskilled operators. In addition, the blank shaping mechanism employed in the manual system is not well suited to being automated without significantly adding to the complexity of the system.

Accordingly, it is an object of this invention to provide improvements in the system and method for forming custom-made shoe inserts disclosed in U.S. patent application Ser. No. 183,010.

Another object of this invention is to provide an automatic system for forming custom-made shoe inserts.

Another object of this invention is to provide such an automatic system with a blank shaping mechanism that is automatically driven to and fro while being automatically driven laterally and that may be automatically so driven in response to a single drive motor.

Another object of this invention is to provide such an automatically-driven blank shaping mechanism for automatically sensing all portions of an impression of a person's foot while simultaneously automatically removing material from a corresponding blank in conformance with the sensed impression so as to form a shoe insert from the blank without requiring an operator to do more than actuate a control switch for starting the blank shaping mechanism.

Another object of this invention is to provide such an automatically-driven blank shaping mechanism for automatically forming a pair of shoe inserts for a person's feet from a corresponding pair of blanks without requiring the constant attention of or any effort by the operator during the blank shaping operation, thereby enabling the operator to concentrate on selling, fitting and other activities and providing an automatic system better suited for use in retail stores and other point of sale locations by relatively unskilled operators.

Another object of this invention is to provide an improved foot impression mechanism for forming a smoother, more continuous impression of the contour of the under surface of a person's foot to facilitate faithful sensing of the impression and, hence, reproduction of the impression in a corresponding blank.

Another object of this invention is to provide an improved foot impression mechanism for providing a smoother, more continuous load-bearing surface of greater area to support a person's foot, thereby reducing the unit pressure on the undersurface of the foot and, hence, the distortion of the contour of the undersurface of the foot in soft fleshy areas compared to harder bony areas so as to obtain a more accurate impression of the actual contour of the undersurface of the foot.

Another object of this invention is to provide an improved foot impression mechanism employing an array of pins for forming an impression of the contour of the undersurface of a person's foot without forming an abrupt vertical transition between the pins contacting the undersurface of the foot and the surrounding pins out of contact with the undersurface of the foot and thus without impeding faithful sensing of the peripheral regions of the impression and, hence, faithful reproduction of those peripheral regions in a corresponding blank.

Another object of this invention is to provide an improved array of pins for forming an impression of the contour of the undersurface of a person's foot and for enabling all of the pins to be locked in place so as to retain the impression by application of a locking force to one side of the array of pins.

Another object of this invention is to provide an improved and more reliable locking assembly for locking in place an array of pins yieldably urged against the contour of the undersurface of a person's foot to retain an impression of the contour of the undersurface of the foot.

Still another object of this invention is to provide an automatic system for forming custom-made shoe inserts that employs a foot impression mechanism and a blank shaping mechanism of simpler, more rugged construction than those employed in the prior manual system.

These and other objects of this invention, which will become apparent from an inspection of the accompanying drawings and a reading of the associated description, are accomplished in accordance with the illustrated preferred embodiment of the invention by employing a dual foot impression mechanism for simultaneously forming a separate impression of the contour of the undersurface of each of a person's feet, and by employing an automatically-driven blank shaping mechanism for successively reproducing each impression in a corresponding blank to form a pair of shoe inserts for the person's feet. The dual foot impression mechanism includes a first substantially continuous array of closely-packed pins yieldably urged against the left foot for forming the impression of the contour of the undersurface of that foot, a second substantially continuous array of closely-packed pins yieldably urged against the right foot for simultaneously forming the impression of the contour of the undersurface of that foot, and first and second cam-operated locking assemblies for respectively locking the first and second arrays of pins in place to retain the impressions formed thereby.

Each array of pins is supported within a rectangular opening of a common housing for vertical movement between retracted and extended positions, is disposed in contact with an inflatable elastic diaphragm for yieldably urging the array of pins towards the extended position and into contact with the undersurface of the corresponding foot, and is arranged in rows and columns with relatively thin elongated spacing members disposed between each column and with the pins and spacing elements disposed in slidable abutting relationship. The cam-operated locking assembly for each array of pins comprises an eccentric cam, a relatively hard elongated resilient pad mounted on a drive member within the common housing adjacent to a common end of each column of the array of pins for movement between an inoperative position out of contact with those columns of pins and an operative position in rigid locking engagement with those columns of pins, a follower member coupled to the eccentric cam and also universally and resiliently coupled to the drive member, and a manually-controlled lever coupled to the eccentric cam for turning it so as to move the follower and drive members towards the columns of pins and thereby move the elongated rubber pad to the operative position in rigid locking engagement with the columns of pins.

The blank shaping mechanism comprises an actuated member having an arm portion with a sensing roller rotatably mounted at one end thereof for successively sensing the impressions formed by the first and second arrays of pins, another arm portion with both a rotary hemispherical cutter and an associated drive motor mounted at one end thereof for successively cutting material away from each blank in conformance with the corresponding sensed impression to successively form the shoe inserts, and a common mounting portion disposed at the other end of each arm portion for mounting the arm portions in a common plane and in spaced relationship corresponding to the spacing between each array of pins and the corresponding blank. A drive mechanism is employed for automatically driving the blank shaping mechanism to successively form the shoe inserts.

The drive mechanism includes an actuator member pivotally mounted along a lowermost portion of the actuator member on a rod extending between opposite sides of a frame for the system. In addition, the drive mechanism includes a threaded drive shaft rotatably mounted in an uppermost portion of the actuator member, and a pair of correspondingly threaded mounting nuts disposed on the drive shaft at spaced positions therealong. The mounting portion of the actuated member is attached to these mounting nuts so as to permit pivotal movement of the actuated member about the drive shaft as the sensing roller rolls along the surface of each impression and also to permit lateral movement of the actuated member along the drive shaft as the drive shaft is rotated.

One end portion of the drive shaft is coupled by a pulley arrangement to a reversible reduction gear motor for rotating the drive shaft in either sense to move the actuated member laterally along the drive shaft in either direction. The gear motor is in turn mounted on a housing pivotally coupled at one end to the drive shaft and at the other end by a link to one side of the frame for the system. A crank member is attached at one end to the other end portion of the drive shaft for rotation with the drive shaft and is pivotally coupled at the other end, by another link to the other side of the frame for the system so as to move the actuator member and, hence, the actuated member to-and-fro between retracted and extended positions as the drive shaft rotates. This moves the sensing roller along all portions of the surface of each impression as the actuated member is moved laterally along the drive shaft in either direction. The various parts of the drive mechanism are positioned and dimensioned so as to provide the actuated member and, hence, both the sensing roller and the hemispherical cutter with substantially matching displacement profiles during movement of the actuated member from the retracted to the extended position and during movement of the actuated member from the extended to the retracted position.

DESCRIPTION OF THE PREFERRED EMBODIMENT

Figure 1:
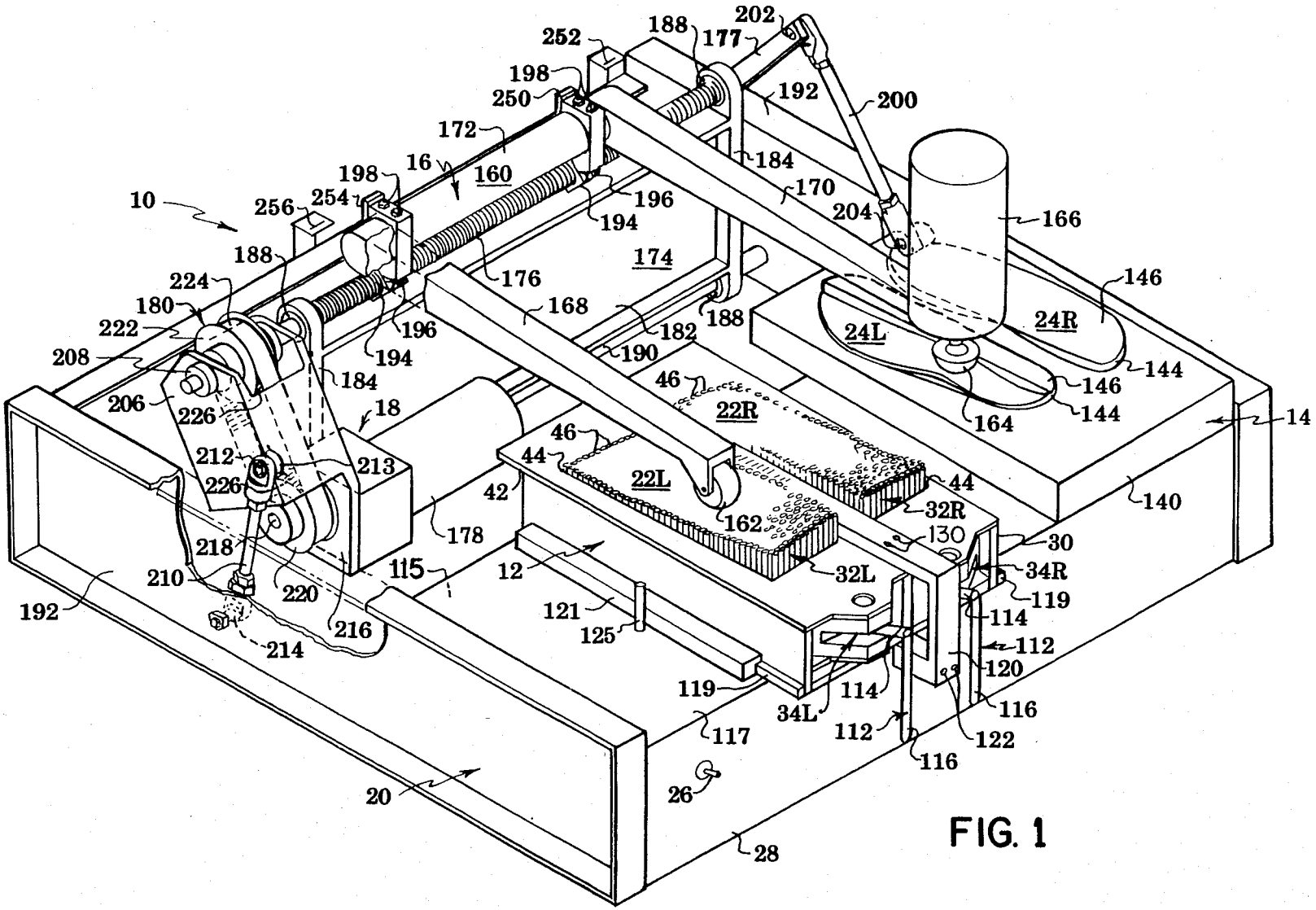
FIG. 1 is a partially cutaway isometric view of an automatic system for forming custom-made shoe inserts in accordance with the preferred embodiment of this invention.

Referring to FIG. 1, there is shown an automatic system 10 for forming a pair of custom-made shoe inserts for a person's feet in accordance with the preferred embodiment of this invention. This system 10 includes a foot impression mechanism 12, a blank holding assembly 14, a blank shaping mechanism 16, and a drive mechanism 18 all supported in cooperative relationship by a frame 20. An operator initially employs the foot impression mechanism 12 to simultaneously form left and right impressions 22L and 22R of the person's left and right feet, and employs the blank holding assembly 14 to hold a pair of left and right blanks 24L and 24R corresponding to the person's shoe size. Once this has been done, the operator actuates a toggle switch 26 on a front panel portion 28 of the frame 20, thereby initiating operation of the drive mechanism 18 for automatically driving the blank shaping mechanism 16 to successively form the custom-made shoe inserts from the blanks 24L and 24R in conformance with the impressions 22L and 22R of the person's feet.

Figure 2:
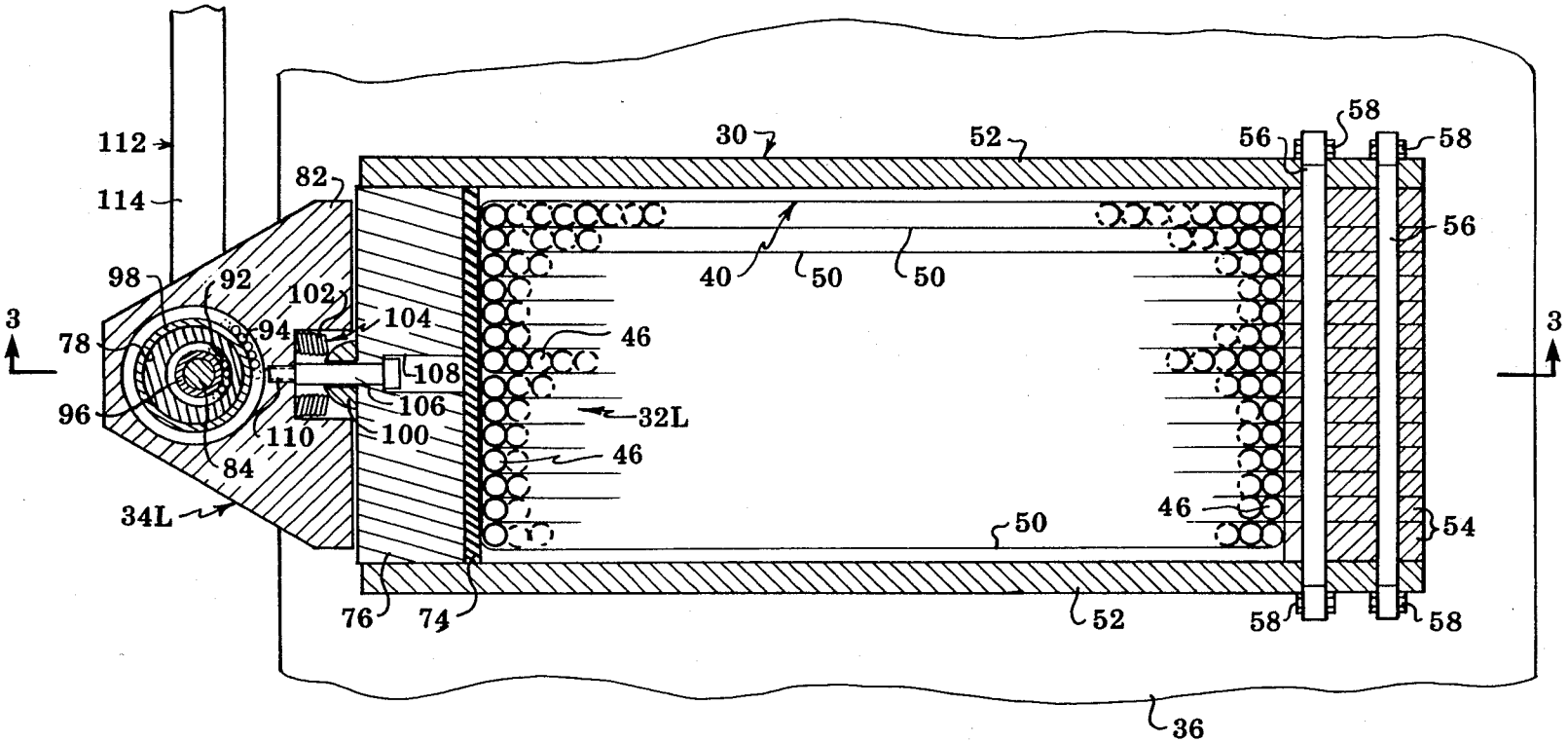
FIG. 2 is a sectional top plan view of a portion of the foot impression mechanism of the system of FIG. 1.
Figure 3:
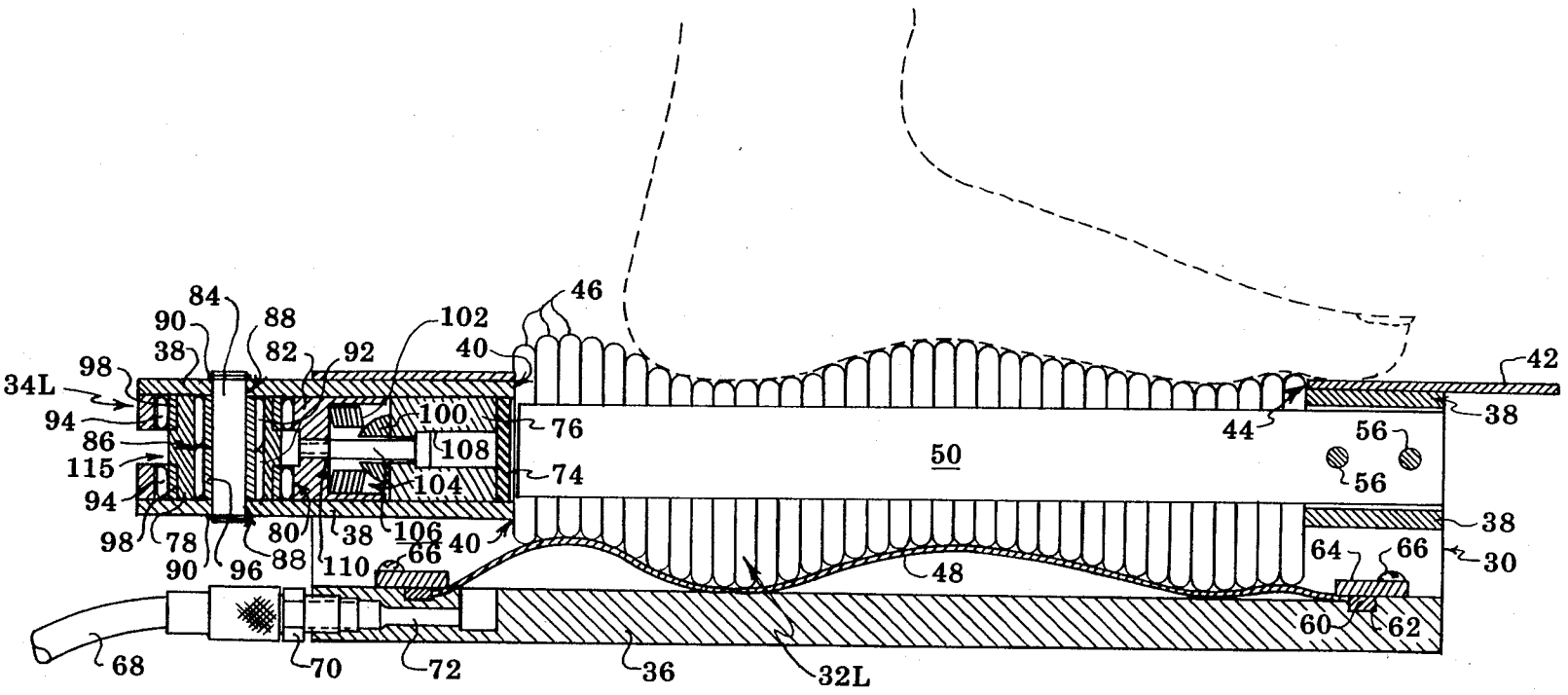
FIG. 3 is a half-sectional side elevational view of the portion of the foot impression mechanism shown in FIG. 2 as taken along the line 3—3 of FIG. 2.

Referring now to FIGS. 1, 2 and 3, it may be seen that the foot impression mechanism 12 includes a housing 30, a pair of identical left and right pin arrays 32L and 32R disposed in the housing in side-by-side relationship for forming the impressions 22L and 22R of the person's left and right feet, and a pair of identical left and right locking assemblies 34L and 34R also disposed in the housing for locking the left and right pin arrays 32L and 32R, respectively, in place to retain the impressions 22L and 22R. The housing 30 has a base portion 36, a pair of vertically-spaced intermediate plates 38 each having a pair of rectangular openings 40 formed in spaced side-by-side relationship therein and axially aligned with the pair of rectangular openings 40 formed in the other intermediate plate, and a top plate 42 having a pair of slightly larger rectangular openings 44 formed in spaced side-by-side relationship therein and axially aligned with the pairs of rectangular openings formed in the intermediate plates 38 to form left and right receptacles for receiving the left and right pin arrays 32L and 32R, respectively. Each of the pin arrays 32L and 32R comprises a substantially continuous array of closely-packed cylindrical steel pins 46 disposed within the corresponding one of these receptacles in contact with the upper surface of a relatively soft (about thirty-five durometer hardness), slightly stretched rubber diaphragm 48 of rectangular shape normally resting on the interior side of the base portion 36 of the housing 30 and extending somewhat beyond the outer periphery of the pin arrays as shown in FIG. 3.

The pins 46 of each of the pin arrays 32L and 32R are rounded at each end and are vertically disposed in contiguous rows and columns with elongated separator members 50 of about one thirty-second of an inch in thickness positioned between each column and disposed along substantially the full length thereof (but terminating slightly before reaching the side of the corresponding pin array closest to the corresponding one of the locking assemblies 34L and 34R). These separator members 50 are vertically disposed between the intermediate plates 38 of the housing 30 and are laterally disposed between a pair of side plates 52 of the housing. The separator members 50 are secured at one end of the housing remote from the locking mechanisms 34L and 34R by spacing members 54, by a pair of rods 56 extending through axially aligned clearance holes formed in each of the separator members 50, spacing members 54 and side plates 52, and by nuts 58 screwed onto threaded end portions of each rod and into rigid abutment against the side plates.

The pins 46 of the pin arrays 32L and 32R are normally vertically movable between a retracted position at which the rounded uppermost end of each pin is located at or slightly below the plane of the upper surface of the top plate 42 so that the person may easily place his left and right feet on the left and right pin arrays, respectively (as shown for the left foot in FIG. 3), and an extended position at which the rounded uppermost end of each pin is located above that plane by as much as one to one and one-half inches depending on the contour of the undersurface of each foot. Vertical movement of the pins 46 of the pin arrays 32L and 32R is controlled by the rubber diaphragm 48, a peripheral lip 60 of which is therefore captivated in air tight engagement with a corresponding rectangular channel 62 formed in the upper surface of the base portion 36 of the housing 30 and disposed somewhat beyond the outer periphery of the pin arrays by a rectangular retainer frame 64 fixedly attached to the base portion by screws 66. The peripheral lip 60 also preferably includes an intermediate portion that extends across the diaphragm 48 between the pin arrays 32L and 32R and that is captivated in air tight engagement with a corresponding intermediate portion of the rectangular channel 62 by a corresponding intermediate portion of the retainer frame 64 also fixedly secured to the base portion of the housing 30 by screws 66. This provides a separately controllable rubber diaphragm 48 for each of the pin arrays 32L and 32R.

By applying air pressure to the lower surface of the rubber diaphragm 48 for each of the pin arrays 32L and 32R through an associated conduit 68 coupled by an associated fitting 70 to an associated passageway 72 extending from one side of the base portion 36 of the housing 30 to the upper surface of the base portion at a location beneath the rubber diaphragm, the pins 46 of each of the pin arrays may be yieldably urged into engagement with the undersurface of the corresponding foot to simultaneously form a separate impression of the contour of the undersurface of each of the person's feet. The elasticity and extent of each rubber diaphragm 48 beyond the outer periphery of the corresponding one of the pin arrays 32L and 32R are selected so that a smooth continuous transition is formed between the pins 46 contacting the undersurface of each foot and the surrounding pins out of contact with the undersurface of each foot as may be seen, for example, in the region of the heel in FIG. 3. The impressions formed by the pin arrays 32L and 32R may be retained by employing the corresponding locking assemblies 34L and 34R to lock the pins 46 in place by applying a locking force to the adjacent end of each column of pins on one side of each of the pin arrays.

Figure 4:
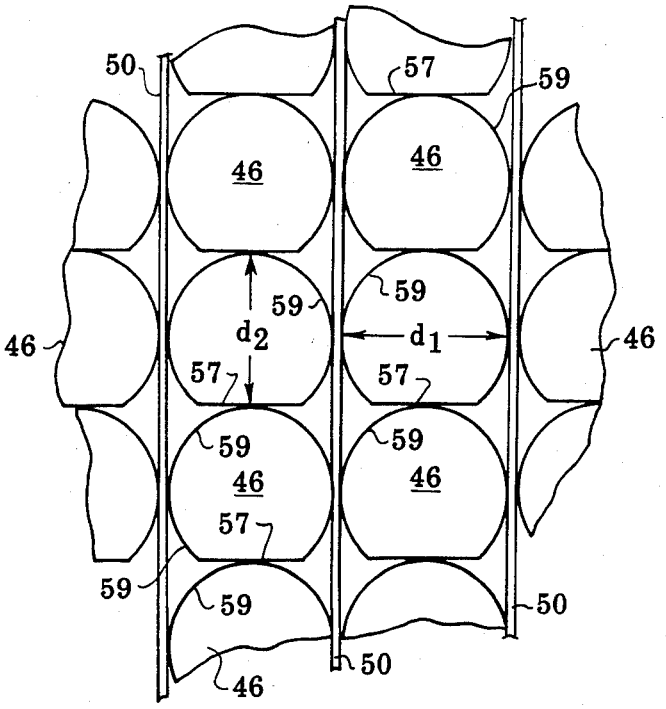
FIG. 4 is an enlarged cross-sectional view of a portion of an array of pins of the type employed in the foot impression mechanism of the system of FIG. 1.

The locking force applied by each of the locking assemblies 34L and 34R to the adjacent end of each column of cylindrical pins 46 of the corresponding one of the pin arrays 32L and 32R is progressively reduced along each column of pins due to the tendency of the cylindrical pins to slip out of columnar alignment. This results in significant lateral forces acting on the cylindrical pins and producing significant frictional forces between the pins and the adjacent separator members 50 (and adjacent parallel side portions of the intermediate plates 38 in the case of the outer columns of pins). As a result the rows of cylindrical pins 46 most remote from the corresponding locking assemblies 34L and 34R may not be positively locked in place without the application of an excessively large locking force. In order to significantly diminish the lateral forces acting on the cylindrical pins 46 and, hence, the frictional forces between the pins and the adjacent separator members 50 (and parallel side portions of the intermediate plates 38), adjoining pins in each column of pins are provided with asymmetric contacting surfaces. This enables the rows of pins 46 most remote from the corresponding locking assemblies 34L and 34R to be positively locked in place without applying an excessively large locking force to the ends of the columns of pins. Thus, as shown in FIG. 4, each of the pins 46 of each of the pin arrays 32L and 32R preferably has a flattened surface 57 along its full length on one side thereof and a rounded surface 59 along its full length on the remaining sides thereof (the dimension $d_1$ of each pin, as diametrically measured across the rounded surface, is preferably 0.3125 inch while the dimension $d_2$ of each pin, as diametrically measured along a line orthogonal to the flattened surface, is preferably 0.3028 inch). In each column of pins 46 of each of the pin arrays 32L and 32R, each pin is disposed with its flattened surface 57 in abutment upon the rounded surface 59 of the adjoining pin furthest from the corresponding one of the locking assemblies 34L and 34R (or in abutment upon the adjacent end portions of the intermediate plates 38 in the case of the row of pins furthest from the corresponding one of the locking assemblies).

Figure 5:
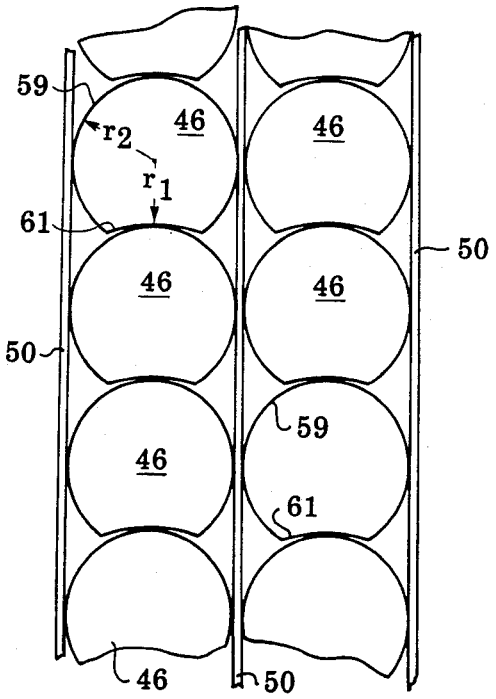
FIG. 5 is an enlarged cross-sectional view of a portion of an array of pins of another type that may alternatively be employed in the foot impression mechanism of the system of FIG. 1.

Adjoining pins 46 in each column of pins of each of the pin arrays 32L and 32R may alternatively be provided with asymmetric contacting surfaces other than those shown in FIG. 4. For example, as shown in FIG. 5, each pin 46 of each of the pin arrays 32L and 32R may be provided with a concave surface 61 having a larger radius of curvature $r_1$ than that $r_2$ of the rounded surface 59 and may be disposed with its concave surface 61 in abutment upon the rounded surface 59 of the adjoining pin furthest from the corresponding locking assembly in the same column (or in abutment upon the adjacent end portions of the intermediate plates 38 in the case of the row of pins furthest from the corresponding one of the locking assemblies).

Each of the locking assemblies 34L and 34R includes a relatively hard (about ninety durometer hardness) rubber pad 74 fixedly secured to one side of a drive member 76 and disposed directly adjacent to a proximate end of each column of pins 46 (the end remote from the rods 56) of the corresponding one of the pin arrays 32L and 32R. The drive member 76 is vertically disposed between the intermediate plates 38 of the housing 30 and laterally disposed between the side plates 52 of the housing for slidable movement between a retracted position, at which the rubber pad 74 is moved slightly out of contact with the proximate end of each column of pins 46 of the corresponding one of the pin arrays 32L and 32R, and an extended position, at which the rubber pad is moved into rigid locking engagement with the proximate end of each of those columns of pins to lock the pins in place and retain the impression formed thereby.

Each of the locking assemblies 34L and 34R further includes a follower member 82 slidably disposed between tapered front end portions of the intermediate plates 38, and an eccentric cam 78 rotatably mounted within a cylindrical hole 80 vertically extending through the follower member by a cylindrical shaft 84 and by first and second pairs of cylindrical drawn cap needle bearings 92 and 94, respectively. Shaft 84 extends through axially aligned cylindrical openings 86 and 88 in the eccentric cam 78 and the tapered front end portion of each of the intermediate plates 38, respectively, and is held in place by spring clips 90 attached at each end of the shaft in abutment with the tapered front end portions of the intermediate plates. The first pair of cylindrical drawn cap needle bearings 92 and an associated cylindrical race 96 are coaxially mounted on the shaft 84 and within the cylindrical opening 86 in the eccentric cam 78, while the second pair of cylindrical drawn cap needle bearings 94 and an associated pair of cylindrical races 98 are coaxially mounted on spaced upper and lower reduced-diameter portions of the eccentric cam 78 and within the cylindrical hole 80 of the follower member 82.

As indicated above, the follower member 82 is vertically disposed between the tapered front end portions of the intermediate plates 38 and is coupled to and captivated by the eccentric cam 78 so as to move between a retracted position (as shown in FIG. 3) and an extended position closer to the corresponding one of the pin arrays 32L and 32R as determined by the rotational position of the eccentric cam. The follower member 82 is also universally and resiliently coupled to the drive member 76 by a hemispherical seating member 100 coaxially and fixedly secured to the drive member 76 on the side thereof directly opposite from the rubber pad 74, by six annular Bellville washers 102, and by a shoulder bolt 106. Bellville washers 102 are coaxially captivated in stacked relationship within a cylindrical opening 104 of the follower member 82 and are seated in abutment upon the hemispherical seating member 100 so as to be compressed when the follower member is moved towards its extended position. Shoulder bolt 106 extends through a clearance hole 108 coaxially formed through the drive member 76 and the adjoining hemispherical seating member 100, extends through the annular Bellville washers 102, and is tightly screwed into a tapped hole 110 coaxially formed through the follower member 82. The clearance hole 108 is reduced in diameter within the drive member 76 to provide a seat for abutment with the head of the shoulder bolt 106 when the follower member 82 is in its retracted position.

Each of the locking assemblies 34L and 34R also includes a manually-controlled lever 112 for rotating the corresponding eccentric cam. A first portion 114 of the lever 112 is fixedly secured at one end to an increased-diameter central portion of the eccentric cam 78 so as to extend laterally outward from between the tapered front end portions of intermediate plates 38 and from a recessed region 115 of a correspondingly tapered front end portion of the follower member 82. This first portion 114 is pivotally coupled at the other end to a second portion 116 that may be used as an operative extension of the first portion to facilitate rotating the eccentric cam when actuating and deactuating the locking mechanism and that may be pivoted downwardly and out of the way when not being so used to lessen the chances of inadvertently actuating or deactuating the locking mechanism.

Each of the locking assemblies 34L and 34R is deactuated to unlock the corresponding one of the pin arrays 32L and 32R by turning the corresponding lever 112 towards the corresponding side of the housing 30 as shown in FIG. 2. As shown in FIGS. 2 and 3, this rotates the corresponding eccentric cam 78 to its forwardmost position thereby moving the corresponding follower member 82 and, hence, the corresponding drive member 76 to their retracted positions at which the corresponding rubber pad 74 is moved slightly out of contact with the proximate end of each of the columns of pins 46 of the corresponding one of the pin arrays 32L and 32R so that an impression of the corresponding one of the person's feet may be formed with that pin array. Each of the locking assemblies 34L and 34R is actuated to lock the corresponding one of the pin arrays 32L and 32R in place and retain the impression formed therewith by turning the corresponding lever 112 towards the center of the housing 30 as shown in FIG. 1. This rotates the corresponding eccentric cam 78 to its rearwardmost position thereby moving the follower member 82 and the drive member 76 to their extended positions at which the corresponding Bellville washers are compressed and the corresponding rubber pad 74 is moved into rigid locking engagement with the proximate end of each of the columns of pins 46 of the corresponding one of pin arrays 32L and 32R (with a force of about four thousand pounds) to lock that pin array in place and retain the impression formed therewith.

The impressions 22L and 22R of the person's feet are formed at predetermined reference positions such that the forwardmost point to which the blank shaping mechanism 16 is driven extends somewhat beyond the back of the heel portion of each impression (by an amount determined by the size of the person's feet) and, as shown for the left foot in FIG. 3, such that the joint of the big toe of each foot is approximately located over the rearwardmost row of pins 46 of each of the pin arrays 32L and 32R. To accommodate different shoe sizes the foot impression mechanism 12 is adjustably mounted on a top panel portion 117 of the frame 20 of the system by a pair of guide bars 119 fixedly secured to opposite sides of the housing 30 of the foot impression mechanism and slidably engaged with an associated pair of guide rails 121 fixedly secured to the top panel portion 117 of the frame. A locking lever 125 rotatably mounted in the left-hand guide rail 121 may be turned to an inoperative position at which a vertically extending portion of the locking lever is spaced away from the associated guide bar 119 so as to permit sliding adjustment of the foot impression mechanism 12 along the guide rails to locate the rearwardmost row of pins 46 of each of the pin arrays 32L and 32R at the appropriate position for the person's particular shoe size. The locking lever 125 may thereupon be turned to an operative position at which the vertically extending portion of the locking lever is driven into abutment with the associated guide bar 119 so as to hold the foot impression mechanism in place while impressions 22L and 22R of the person's feet are formed.

Figure 6:
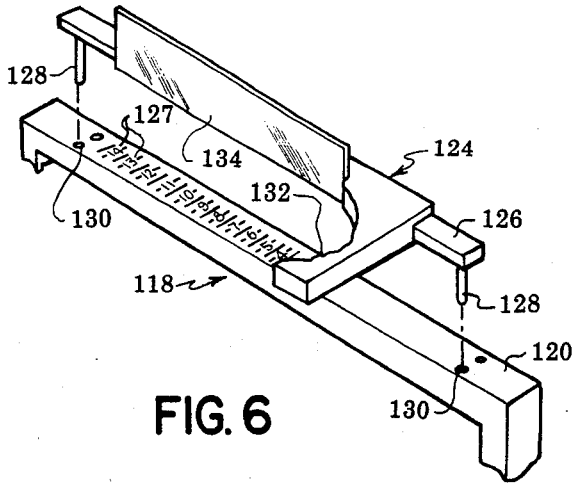
FIG. 6 is an isometric view of a foot registration assembly employed with the foot impression mechanism of the system of FIG. 1.
Figure 7:
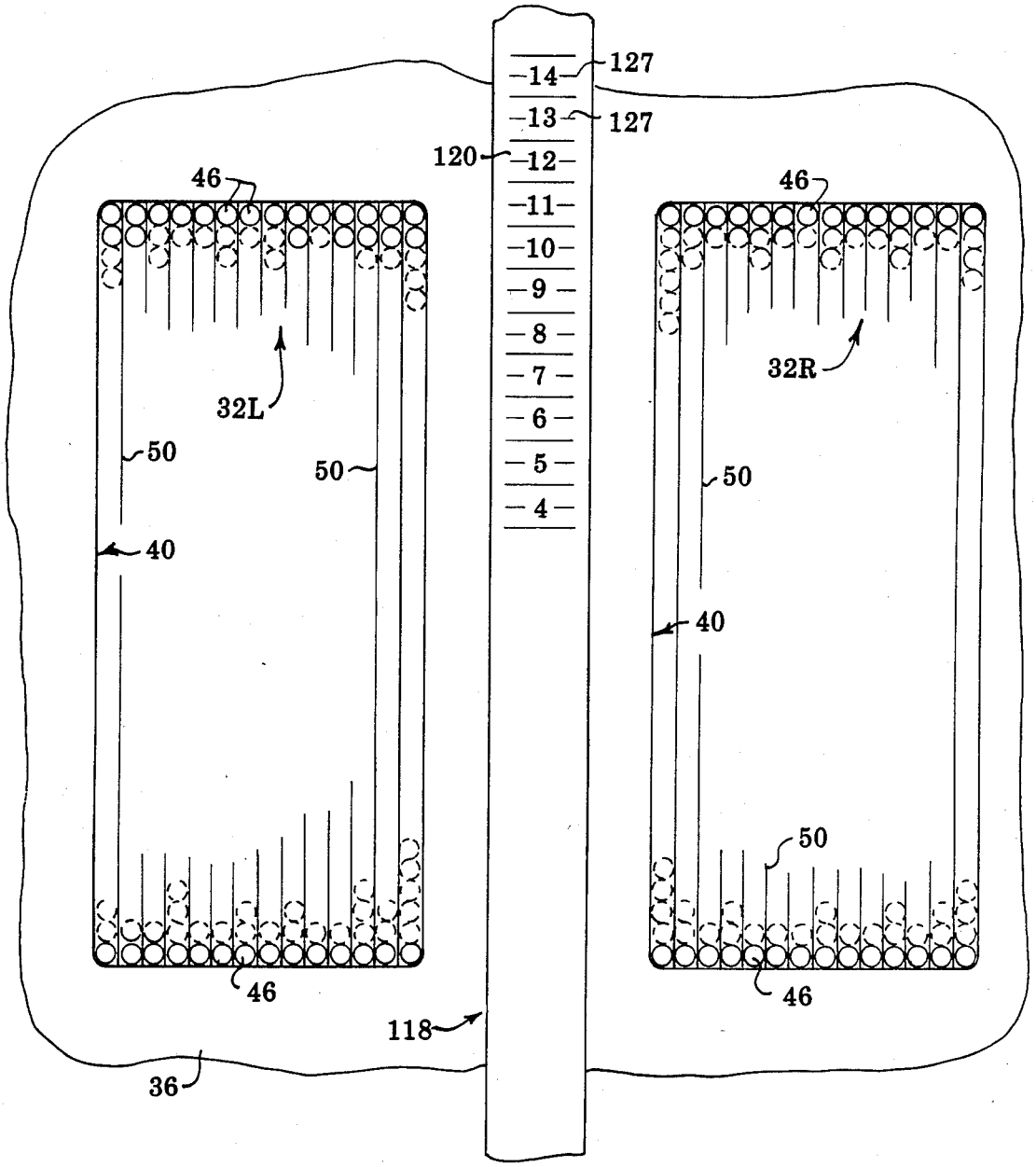
FIG. 7 is a top plan view of a portion of the foot registration assembly of FIG. 6 as employed with the foot impression mechanism of the system of FIG. 1.

To facilitate adjusting the position of the foot impression mechanism 12 for the person's particular shoe size and to facilitate placing the left and right feet at the corresponding reference positions, a foot registration assembly 118 shown in FIGS. 6 and 7 is employed with the foot impression mechanism. Referring now to these figures, along with FIG. 1, it may be seen that the foot registration assembly 118 includes a rigid mounting bar 120 that is symmetrically disposed between pin arrays 32L and 32R of the foot impression mechanism 12 in a plane parallel to the upper surface of the housing 30, and that is secured to the front panel portion 28 of the frame 20 and to a parallel intermediate portion 115 of the frame by corresponding pairs of bolts 122. The mounting bar 120 is spaced from the upper surface of the housing 30, from the front panel portion 28 of the frame 20, and from the parallel intermediate portion 115 of the frame so as to provide clearance space for adjustment of the foot impression mechanism 12 to accommodate the person's particular shoe size. This adjustment may be made by simply sliding the foot impression mechanism 12 along the guide rails 121 to a position at which the rearwardmost row of pins 46 of each of the pin arrays 32L and 32R is aligned with the appropriate one of a column of shoe size indicia 127 (i.e., the one designating the person's shoe size) provided on the upper surface of the mounting bar 120.

The foot registration assembly 118 further includes left and right registration members 124 each having a bar 126 with a pair of longitudinally-spaced, downwardly-directed mounting pins 128 disposed for insertion into an associated pair of longitudinally-spaced mounting holes 130 formed in the mounting bar 120. Each of the left and right registration members 124 also has a heel receiving portion 132 and a side guide portion 134 for locating the corresponding foot at the corresponding reference position overlying the corresponding one of the pin arrays 32L and 32R once the position of the foot impression mechanism 12 is adjusted for the person's shoe size and the mounting pins 128 of the registration member are inserted into the associated mounting holes 130 of the mounting bar 120.

Figure 8:
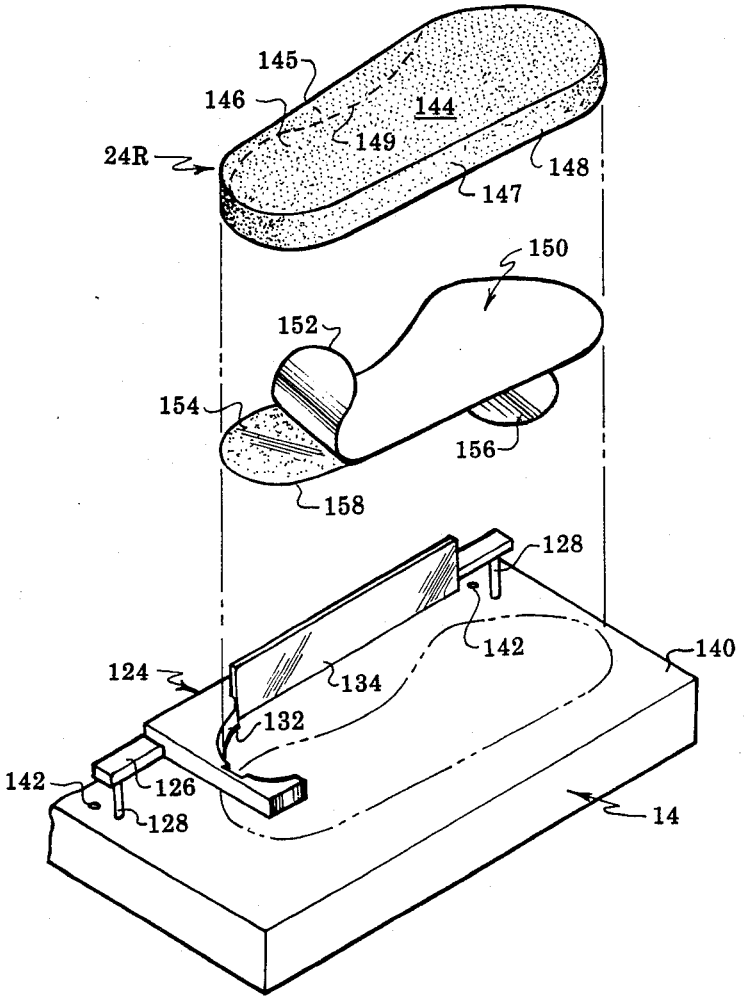
FIG. 8 is a partially exploded isometric view of a portion of the blank support assembly of the system of FIG. 1.

Referring now to FIGS. 1 and 8, the blank holding assembly 14 comprises a platform 140 with an upper surface lying in a plane parallel to and slightly (about one-tenth of an inch) below the upper surface of the top plate 42 of the housing 30 of the foot impression mechanism 12. Left and right blanks 24L and 24R corresponding to the person's shoe size are secured to the upper surface of the platform 140 at predetermined reference positions corresponding to and laterally aligned with the predetermined reference positions of the left and right impressions 22L and 22R, respectively, so that the left and right blanks are laterally aligned and positioned in correspondence with the left and right impressions and therefore properly positioned with respect to the blank shaping mechanism 16. To facilitate locating the left and right blanks 22L and 22R at the corresponding reference positions, the left and right registration members 124 are also employed with the blank holding mechanism 14 in substantially the same manner as they are employed with the foot impression mechanism 12. The heel receiving portion 132 and the side guide portion 134 of each of the left and right registration members 124 are properly positioned for locating the corresponding one of the blanks at the corresponding reference position by inserting the corresponding pair of longitudinally-spaced mounting pins 128 into a corresponding pair of longitudinally-spaced mounting holes 142 formed in the upper surface of the platform 140.

Each of the blanks 24L and 24R comprises a body 144 of, for example, cork, foam rubber or some other such suitable material of substantially uniform thickness (one to one and one-half inches) from heel to toe with flat top and bottom surfaces 146 and 148, respectively. The inner and outer sides 145 and 147 of each of the blanks 24L and 24R extend in substantially straight lines from the narrower heel region to the wider toe region except that the lower portion of the inner side 145 of each of the blanks is relieved in conformance with the contour of the lower portion of the arch as indicated by the dashed line 149 in FIG. 8. Use of blanks 24L and 24R shaped in this manner is very important in forming custom-made shoe inserts therefrom that faithfully conform to and fully support the arch portions of the person's feet (although each blank may also be relieved or precut in other regions such as the toe region).

The blanks 24L and 24R are secured to the top surface of the platform 140 at the corresponding reference positions by employing double-sided pressure-sensitive adhesive patterns 150 each precut in conformance with the size and shape (of the bottom surface 148) of an associated one of the blanks, as shown in FIG. 8. A protective covering 152 is peeled off the topside of each pattern 150 so that the exposed adhesive top surface 154 of the pattern may be aligned with and removably secured to the matching bottom surface 148 of the corresponding one of the blanks 24L and 24R. This may be done either at the time the blanks 24L and 24R are to be used or at any earlier time following fabrication of the blanks. When the blanks 24L and 24R are to be used, a similar protective covering 156 is peeled off the bottom side of the pattern 150 secured to each of those blanks so as to expose the adhesive bottom surface of each of those patterns and permit the blanks to be removably secured to the upper surface of the platform 140 at the corresponding reference positions.

Once the left and right impressions 22L and 22R of the person's left and right feet have been formed in the corresponding reference positions by the left and right pin arrays 32L and 32R and have been retained in those positions by the left and right locking assemblies 34L and 34R, and once the left and right blanks 24L and 24R of the person's shoe size have been secured to the upper surface of the platform 140 in the corresponding reference positions, the blank shaping mechanism 16 is automatically driven by the drive mechanism 18 to automatically and successively form the left and right shoe inserts from the left and right blanks in conformance with the left and right impressions. As shown in FIG. 1, the blank shaping mechanism 16 comprises an actuated member 160, a sensing roller 162 of about two inches in diameter, a hemispherical cutter 164 also of about two inches in diameter, and a drive motor 166 for the hemispherical cutter. The actuated member 160 includes an elongated sensing arm portion 168 with the sensing roller 162 rotatably mounted at one end thereof, and a parallel elongated cutting arm portion 170 with the drive motor 166 fixedly mounted at one end thereof and with the hemispherical cutter 164 rotatably mounted at the same end thereof. Hemispherical cutter 164 is also coupled to the drive motor 166 for being automatically driven thereby in response to actuation of the toggle switch 26 for starting the drive mechanism 18. In addition, the actuated member 160 includes a common mounting portion 172 to which the other end of each of the sensing and cutting arm portions 168 and 170 is fixedly joined so that the sensing and cutting arm portions (and, hence, the sensing roller 162 and the hemispherical cutter 164) are disposed for movement together in a common plane and are spaced apart by a distance equal to the center-to-center spacing between the reference position at which each impression 22L and 22R is formed by the foot impression mechanism 12 and the reference position at which each corresponding blank 24L and 24R is secured to the upper surface of the platform 140 of the blank holding assembly 14.

As further shown in FIG. 1, the drive mechanism 18 includes an actuator member 174, a drive shaft 176, a crank member 177, a reversible reduction gear motor 178, and a pulley arrangement 180 for coupling the drive shaft to that gear motor. The actuator member 174 has a rectangular central section 182 and a pair of adjoining end sections 184. Each of these end sections 184 has a pair of upper and lower end portions extending beyond the uppermost and lowermost surfaces of the central section 182 and having a corresponding pair of annular ball bearings 188 fixedly mounted therein. The actuator member 174 is pivotally mounted on a cylindrical rod 190 that extends through the annular ball bearings 188 in the lower end portions of end sections 184, that extends along the lowermost surface of the central section 182 at a finite distance therefrom, and that is fixedly secured at the opposite ends thereof to a pair of side panel portions 192 of the frame 20 of the system 10. This allows the actuator member 174 to be pivoted to-and-fro about the rod 190 towards and away from the foot impression mechanism 12 and the blank mounting assembly 14.

The threaded drive shaft 176 has a threaded central portion (with a pitch of about one-eighth inch per turn) that extends along the uppermost surface of the central section 182 of the actuator member 174 at a finite distance therefrom, and a pair of smooth adjoining end portions that extend through the annular ball bearings 188 in the upper end portions of end sections 184 of the actuator member 174 but not as far as the side panel portions 192 of the frame 20. This permits the drive shaft 176 to be rotated while the actuator member 174 is being pivoted to-and-fro. The drive shaft 176 is provided with a pair of mounting nuts 194 screwed onto the threaded central portion thereof in spaced-apart relationship. These mounting nuts 194 are fixedly and symmetrically secured to the mounting portion 172 of the actuated member 160 by a pair of U-bolts 196 engaging corresponding grooves in the mounting nuts, passing through corresponding holes in the mounting portion of the actuated member, and held in place by corresponding locking nuts 198 tightly screwed onto the end portions of the U-bolts and into rigid abutment with the mounting portion of the actuated member. This permits the actuated member 160 to move laterally along the drive shaft 176 and, hence, the sensing roller 162 and the hemispherical cutter 164 to move laterally along the upper surface of the foot impression mechanism 12 and the upper surface of the blank holding assembly 14, respectively, in a direction determined by the sense in which the drive shaft is rotated. Additionally, this permits the actuated member 160 to pivot about the threaded central portion of the drive shaft 176 under control of the sensing roller 162, which is yieldably urged against the upper surface of the foot impression mechanism 12 by the weight of the actuated mechanism.

The crank member 177 is fixedly attached at one end thereof to one of the smooth end portions of the drive shaft 176 so as to rotate with the drive shaft, but in a plane orthogonal to the longitudinal axis of the drive shaft. Crank member 177 is pivotally coupled at the other end thereof to an adjacent one of the side panel portions 192 of the frame 20 by a link 200 that is rotatably coupled at one end to a mounting pin 202 fixedly secured to the crank member and that is rotatably coupled at the other end to another mounting pin 204 fixedly secured to the adjacent side panel portion of the frame. This causes the actuator member 174 and the drive shaft 176 rotatably mounted thereon to pivot to-and-fro about the rod 190 as the drive shaft is rotated in either sense. Since the actuated member 160 is pivotally coupled to the drive shaft 176 by mounting nuts 194, the sensing roller 162 and the hemispherical cutter 164 are therefore driven to-and-fro, as well as laterally, across the upper surface of the foot impression mechanism 12 and the upper surface of the blank holding assembly 14, respectively, as the drive shaft 176 is rotated in either sense.

A housing 206 for supporting the reversible reduction gear motor 178 is pivotally mounted near one end thereof on the other smooth end portion of the drive shaft 176 by a pair of annular ball bearings 208 fixedly mounted in a pair of spaced side portions of the housing and coaxially aligned for receiving the drive shaft. The housing 206 is pivotally coupled near the other end thereof to another adjacent one of the side panel portions 192 of the frame 20 by another link 210 that is rotatably coupled at one end to a mounting pin 212 fixedly secured to a raised mounting portion 213 of the housing and that is rotatably coupled at the other end to another mounting pin 214 fixedly secured to the adjacent side panel portion of the frame. This allows the housing 206 and, hence, the reversible reduction gear motor 178, which is fixedly secured to a downwardly extending mounting portion 216 of the housing, to pivotally follow the to-and-fro movement of the actuator member 174 and the drive shaft 176 mounted thereon.

A rotatable drive shaft 218 of the reversible reduction gear motor 178 extends through a clearance opening therefor in the downwardly extending mounting portion 216 of the housing 206. This drive shaft 218 is coupled to the drive shaft 176 by the pulley arrangement 180 so as to rotate the drive shaft 176 in the same sense as the drive shaft 218 is rotated by the reversible reduction gear motor 178. The pulley arrangement 180 comprises a first pulley 220 fixedly secured to the drive shaft 218 for rotation therewith, a second pulley 222 fixedly secured to the same smooth end portion of the drive shaft 176 as the housing 206 (and centrally disposed between the side portions of that housing) so that the drive shaft 176 may be rotated by the second pulley, and a continuous cogged drive belt 224 mounted on and tautly extending between correspondingly toothed central portions 226 of the first and second pulleys so as to rotate the second pulley and, hence, the drive shaft 176 concomitantly with the first pulley and the drive shaft 218.

Figure 9:
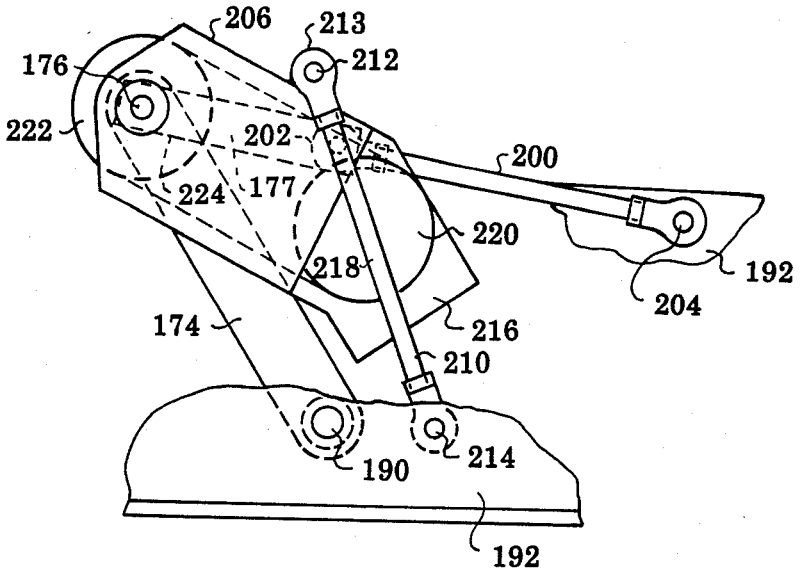
FIG. 9 is a side elevational view of the drive mechanism of the system of FIG. 1 when the drive mechanism is located at a retracted position.
Figure 10:
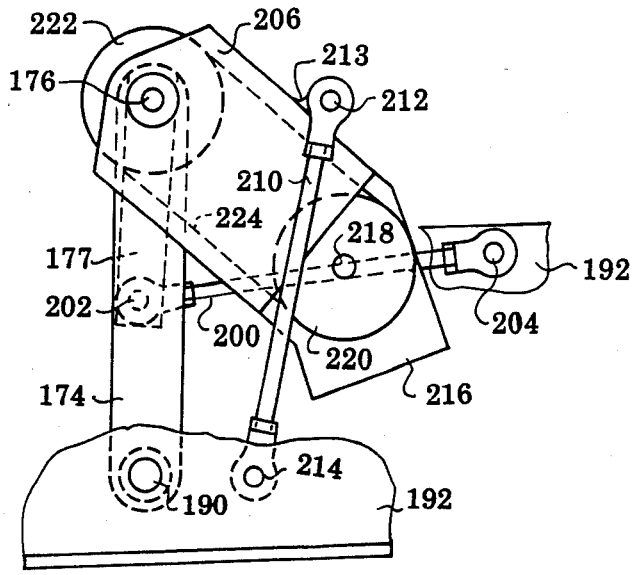
FIG. 10 is a side elevational view of the drive mechanism of the system of FIG. 1 when the drive mechanism is located at an intermediate position.
Figure 11:
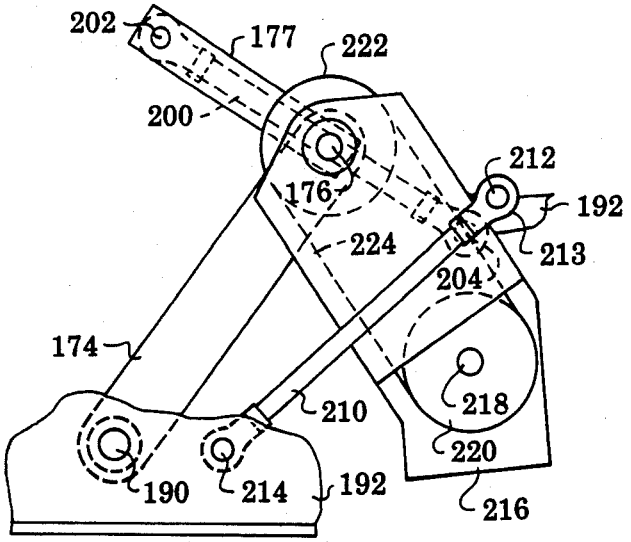
FIG. 11 is a side elevational view of the drive mechanism of the system of FIG. 1 when the drive mechanism is located at an extended position.

The drive shaft 176 drives the actuated member 160 and, hence, the sensing roller 162 and the hemispherical cutter 164 laterally in one direction across the upper surface of the foot impression mechanism 12, when the gear motor 178 rotates the drive shaft 218 in one sense, and laterally in the opposite direction back across the upper surface of the foot impression mechanism, when the gear motor is reversed so as to rotate the drive shaft 218 in the opposite sense. As illustrated by the sequence of positions of the drive mechanism 18 shown in FIGS. 9–12, the drive shaft 176 also rotates the crank member 177 and thereby pivots the actuator member 174 to-and-fro about the rod 190 so as to simultaneously drive the actuated member 160 and, hence, the sensing roller 162 and the hemispherical cutter 164 to-and-fro across the upper surface of the foot impression mechanism 12 while they are being driven laterally thereacross in either direction (this to-and-fro movement being orthogonal to the lateral movement). Thus, when the drive shaft 176 is being rotated in the clockwise direction, the actuator member 174 is pivoted forward from its rearwardmost position (shown in FIG. 9) through an intermediate position (shown in FIG. 10) to its forwardmost position (shown in FIG. 11) so as to drive the actuated member 160 and, hence, the sensing roller 162 and the hemispherical cutter 164 forward across the upper surface of the foot impression mechanism. The actuator member 174 is thereupon pivoted backward from its forwardmost position (shown in FIG. 11) through another intermediate position (shown in FIG. 12) to its rearwardmost position (shown in FIG. 9). This completes one cycle of operation of the drive mechanism 18 during which the actuated member 160 and, hence, the sensing roller 162 and the hemispherical cutter 164 are also continuously driven laterally to the right (although at a much slower rate) across the upper surface of the foot impression mechanism 12.

Figure 12:
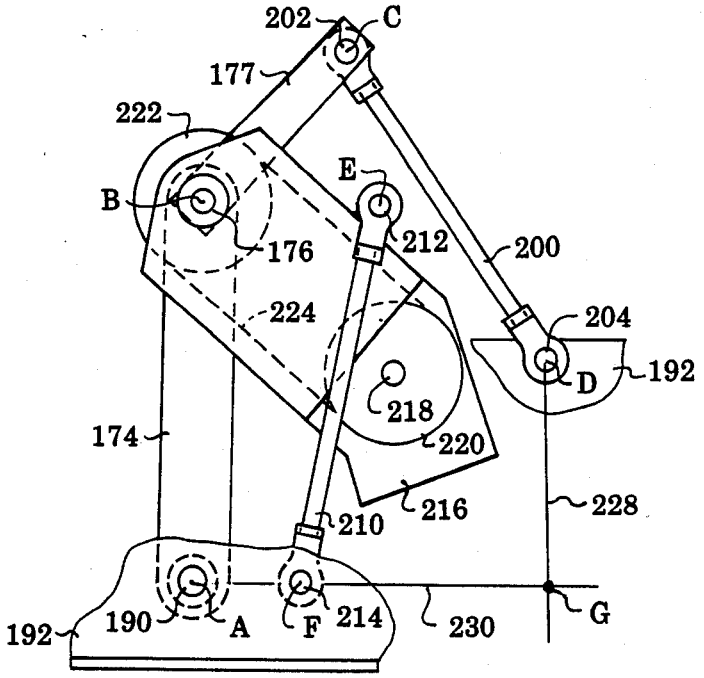
FIG. 12 is a side elevational view of the drive mechanism of the system of FIG. 1 when the drive mechanism is located at another intermediate position.
Figure 13:
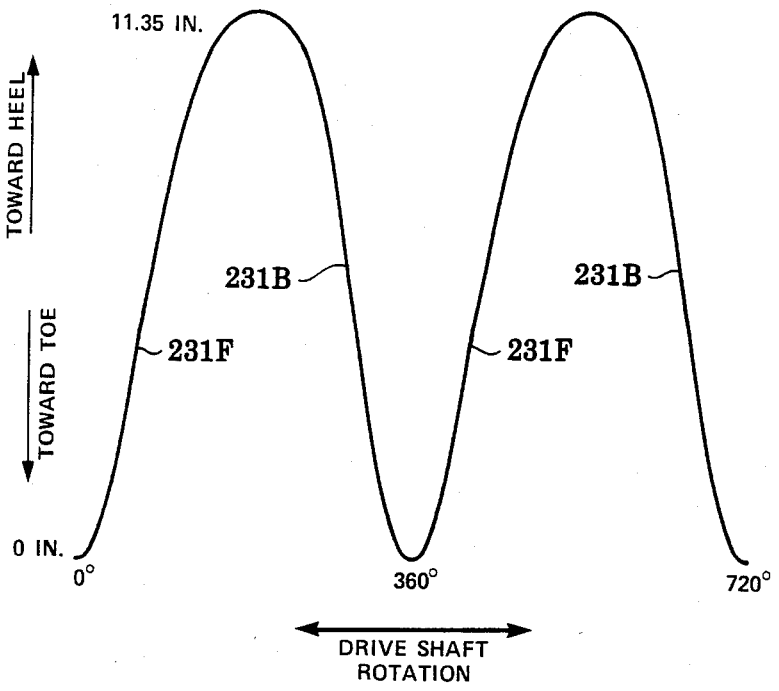
FIG. 13 is a plot of the displacement profile of the blank shaping mechanism of the system of FIG. 1 as driven by the drive mechanism of FIGS. 1 and 9–12.

The various parts of the drive mechanism 18 are positioned and proportioned in accordance with the following linear distances as related to the letters A through G in FIG. 12, where, for example, AB refers to the center-to-center distance between rod 190 and drive shaft 176, DG refers to the linear distance between the center of mounting pin 204 and a point defined by the intersection of a line 228 passing through the center of mounting pin 204 and an orthogonally intersecting line 230 passing through the center of rod 190 and the center of mounting pin 214, etc:

AB=10.0 inches
BC=5.5 inches
CD=b 10.0 inches
BE=4.9 inches
EF=10.2 inches
AF=3.0 inches
AG=9.6 inches
DG=6.0 inches When constructed in this manner, the drive mechanism 18 drives the blank shaping mechanism 16 forward and backward across the upper surface of the foot impression mechanism 12 with a stroke of about 11.35 inches and with substantially matching displacement profiles 231F and 231B, as shown in FIG. 13 where linear displacement of the blank shaping mechanism is plotted as a function of the degrees of rotation of the drive shaft 218 of the reversible gear motor 178 for two cycles of operation. As further shown in FIG. 13, the drive mechanism 18 also provides the blank shaping mechanism 16 with the greatest dwell time at the forwardmost portion of the stroke adjacent to the heel regions of the impressions 22L and 22R and blanks 24L and 24R.

A permanent magnet 250 attached to the mounting portion 172 of the actuated member 160 near one end thereof actuates a reed switch 252 mounted on the frame 20 near one side panel portion 192 thereof to turn off the reversible gear motor 178 via a relay (not shown) when the actuated member is in both its retracted position and a rightmost lateral position, at which the sensing roller 162 has completely traversed all portions of both pin arrays 32L and 32R and at which the hemispherical cutter 164 has accordingly also completely traversed all portions of both blanks 24L and 24R so as to form a pair of custom-made shoe inserts therefrom in conformance with the impressions 22L and 22R. The locking assemblies 34L and 34R may then be deactuated to release the pin arrays 32L and 32R, thereby permitting all of the pins 46 to return to their normal retracted position. Impressions 22L and 22R of another person's feet may then be formed and retained by employing the pin arrays 32L and 32R and the locking assemblies 34L and 34R of the foot impression mechanism 12 in the same manner as previously described. Concomitantly, another pair of blanks 24L and 24R may be removably secured to the blank holding mechanism 14 in place of the shoe inserts previously formed and in the same manner as previously described. The toggle switch 26 on the front panel portion 28 of the frame 20 may thereupon be actuated for causing the drive mechanism 18 to drive the blank shaping mechanism 16 back across the upper surface of the foot impression mechanism 12 in the same manner as previously described. Another permanent magnet 254 attached to the mounting portion 172 of the actuated member 160 near the other end thereof actuates another reed switch 256 mounted on the frame 20 near the other side panel portion 192 thereof to turn off the reversible gear motor 178 via the aforementioned relay when the actuated member is in both its retracted position and a leftmost lateral position, at which the sensing roller 162 has again completely traversed all portions of both pin arrays 32L and 32R and at which the hemispherical cutter 164 has accordingly again also completely traversed both blanks 24L and 24R so as to form a pair of custom-made shoe inserts therefrom in conformance with the current impressions 22L and 22R.

Figure 14:
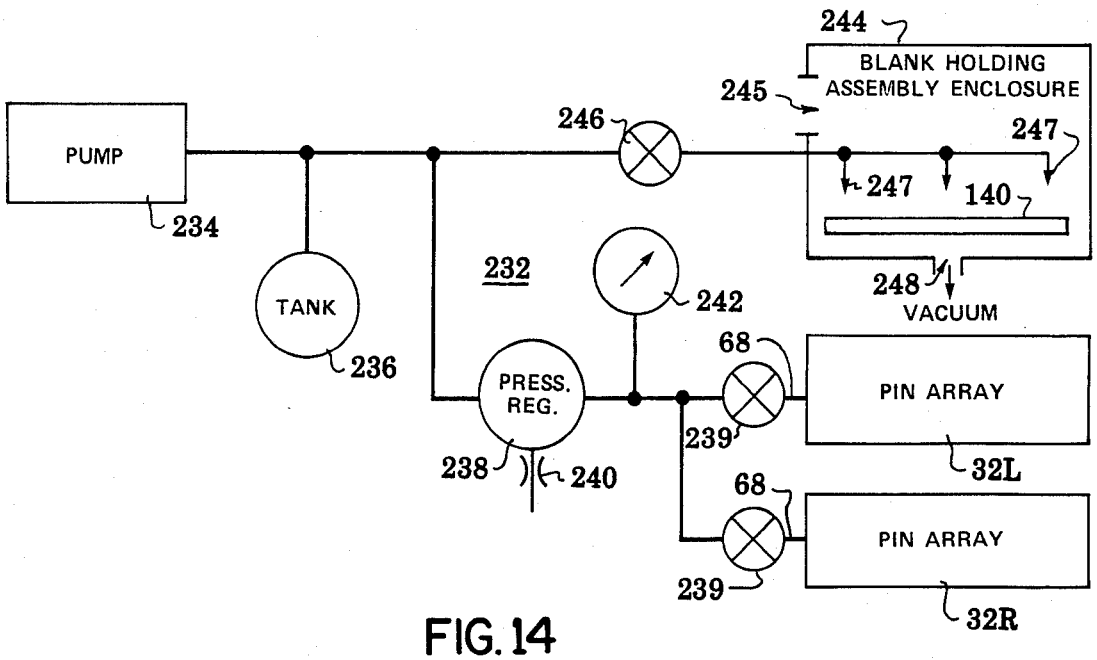
FIG. 14 is a pneumatic circuit diagram of a pneumatic control circuit for the foot impression mechanism and a waste cuttings removal portion of the system of FIG. 1.

Referring now to FIG. 14, there is shown a pneumatic circuit 232 for operating the pin arrays 32L and 32R of the foot impression mechanism 12 and also for removing cuttings produced during shaping of the blanks 24L and 24R into custom-made shoe inserts. This pneumatic circuit 232 includes a pump 234 for pumping air into an air holding tank 236. Air may be applied from the holding tank 236 through a pressure regulator 238 to the underside of the diaphragm 48 for each of the pin arrays 32L and 32R via an associated valve 239 (when open) and the associated conduit 68 to elevate the pins 46 of the pin arrays 32L and 32R from their retracted positions towards their extended positions and thereby yieldably urge the pins of each of the pin arrays into contact with the contour of the undersurface of the foot placed thereon. A bleeder orifice 240 comprising an integral part of the pressure regulator 238 permits air to escape from the underside of the diaphragm 48 for each of the pin arrays 32L and 32R once the pin arrays are locked in place and the applied air pressure is reduced to zero, thereby permitting the pins 46 to return to their normal retracted positions under their own weight when the pin arrays are unlocked. The pressure regulator 238 and a pressure meter 242, which is coupled between the pressure regulator and the valves 239, are employed by the operator to regulate the air pressure applied to the underside of the diaphragm 48 for each of the pin arrays 32L and 32R (when the valves 239 are open) from zero pounds per square inch (for leaving the pins 46 of the pin arrays in or permitting them to return to their normal retracted positions) to a normal working pressure of one to four pounds per square inch (for elevating the pins towards their extended positions and thereby yieldably urging them into contact with the person's feet). When the valve 239 associated with either of the pin arrays 32L and 32R is closed, the pressure regulator 238 and the pressure meter 242 may be employed to independently regulate the air pressure applied to the underside of the diaphragm 48 for the other pin array as may be desired for a person having feet with substantially difference physical characteristics.

In order to simplify control and removal of the cuttings produced during shaping of the blanks 24L and 24R into custom-made shoe inserts, an enclosure 244 is provided for the blank holding assembly 14 of the system 10. This enclosure 244 has an air inlet and clearance opening 245 for receiving the cutting arm portion 170 of the actuated member 160, and an exhaust port 248 for receiving the cuttings. Air from the air holding tank 236 is applied through a pulse valve 246 (when open) to a plurality of nozzles 247 appropriately arranged within the enclosure 244 so as to blow the cuttings off the platform 140 of the blank holding assembly 14 and permit them to be readily drawn out of the enclosure and into a waste removal container (not shown) through the exhaust port 248 by a source of vacuum. The pulsed flow of air into the enclosure 244 may be shut off when the system 10 is not in use by simply closing the pulse valve 246.

I claim:

1. A system for forming a custom-made shoe insert for a person's foot, said system comprising:

impression means for forming and releasably retainng an impression of the contour of the undersurface of the person's foot;

holding means for holding a blank;

sensing and shaping means for sensing the impression and removing material from the blank in conformance with the sensed impression; and drive means for automatically driving the sensing and shaping means both laterally and to-and-fro across the impression and the blank to automatically form the custom-made shoe insert from the blank in conformance with the impression.

2. A system as in claim 1 wherein:

said drive means includes a drive motor; and said sensing and shaping means is driven both laterally and to-and-fro across the impression and the blank in response to that same drive motor.

3. A system as in claim 1 wherein said sensing and shaping means is pivotally mounted for following the contour of the impression and forming an insert having a corresponding contour.

4. A system as in claim 3 wherein:

said drive means includes an actuator member mounted for to-and-fro movement relative to the impression means and the holding means;

said sensing and shaping means is mounted on the actuator member for lateral movement relative to the impression means and the holding means, for to-and-fro movement with the actuator member relative to the impression means and the holding means, and for pivotal movement relative to the actuator member; and said drive means includes motor-driven means for driving the sensing and shaping means laterally and the actuator member to-and-fro relative to the impression means and the holding means to automatically drive the sensing and shaping means both laterally and to-and-fro across the impression and the blank.

5. A system as in claim 4 wherein:

said motor driven means includes a drive shaft rotatably mounted on the actuator member;

said sensing and shaping means is mounted on the drive shaft for translational movement along the drive shaft in response to rotation of the drive shaft and for pivotal movement about the drive shaft; and said motor-driven means includes a drive motor coupled to the drive shaft for rotating the drive shaft to drive the sensing and shaping means along the drive shaft and laterally across the impression and the blank.

6. A system as in claim 5 wherein:

said system includes a housing for supporting the drive means;

said actuator member is pivotally mounted along one side thereof on the housing;

said drive shaft is rotatably mounted along an oppositely-facing side of the actuator member; and said motor-driven means includes a crank member fixedly attached to the drive shaft for rotation therewith and a link member pivotally coupled to the crank member and to the housing so that rotation of the drive shaft moves the actuator member to-and-fro relative to the impression means and the holding means to drive the sensing and shaping means to-and-fro across the impression and the blank.

7. A system as in claim 6 wherein:

said drive shaft has a threaded portion;

said sensing and shaping means includes mounting means having a threaded portion engaged with the threaded portion of the drive shaft so that rotation of the drive shaft moves the sensing and shaping means along the threaded portion of the drive shaft to drive the sensing and shaping means laterally across the impression and the blank, while the sensing and shaping means is simultaneously being driven to-and-fro across the impression and the blank, and so that the sensing and shaping means may pivot about the drive shaft in accordance with the contour of the impression.

8. A system as in claim 7 wherein:

said sensing and shaping means includes an arm portion having a sensing element mounted at one end thereof for sensing the contour of the impression, and another arm portion having a cutting element mounted at one end thereof for removing material from the blank in accordance with the sensed contour of the impression; and said mounting means includes a common mounting portion provided at an oppositely-facing end of each of the arm portions to support the arm portions in laterally spaced relationship with the sensing element adjacent to the impression means and the cutting element adjacent to the holding means.

9. A system as in claim 8 wherein:

said sensing element comprises a roller rotatably mounted for contacting the impression and following the contour thereof;

said cutting element comprises a hemispherical cutter rotatably driven for remvoing material from the blank; and said system includes a drive motor for driving the hemispherical cutter.

10. A system as in claim 9 wherein:

said arm portions are supported by the common mounting portion in a common plane; and said last-mentioned drive motor is mounted on the same arm portion as the hemispherical cutter.

11. A system as in claim 8 wherein said motor-driven means includes:

a support member mounted at one end portion thereof on the drive shaft for pivotal movement about the drive shaft;

a first pulley fixedly mounted on the drive shaft adjacent to the same end portion of the support member for rotating the drive shaft;

a second pulley rotatably disposed adjacent to an oppositely-facing end portion of the support member and coupled to the drive motor for being rotated by the drive motor;

said drive motor and the second pulley being mounted at the last-mentioned end portion of the support member for pivotal movement with the support member;

a drive belt engaged with the first and second pulleys for rotating the first pulley in response to rotation of the second pulley; and another link member pivotally coupled to the support member and to the housing so that the support member follows the to-and-fro movement of the actuator member as the drive shaft rotates.

12. A system as in claim 11 wherein:

said support member is mounted on a smooth portion of the drive shaft;

each of said first and second pulleys has a toothed peripheral portion; and said drive belt comprises a continuous cogged drive belt engaged with the toothed peripheral portion of each pulley.

13. A system as in claim 1 including switching means for controlling operation of the drive means to automatically drive a sensing portion of the sensing and shaping means both laterally and to-and-fro across the impression and to simultaneously automatically drive a shaping portion of the sensing and shaping means both laterally and to-and-fro across the blank.

14. A system as in claim 13 wherein:

said sensing portion includes an arm member having a sensing element mounted at one end thereof for sensing the contour of the impression;

said shaping portion includes another arm member having a cutting element mounted at one end thereof for removing material from the blank in accordance with the sensed contour of the impression; and said sensing and shaping means includes a mounting portion disposed at the other end of each of the arm members for pivotally supporting the arm members in laterally spaced relationship with the sensing element adjacent to the impression means and the cutting element adjacent to the holding means.

15. A system as in claim 1 wherein:

said impression means includes a first portion for forming and releasably retaining an impression of the contour of the undersurface of one of a person's feet, and a second portion, disposed in side-by-side relationship with the first portion, for forming and releasably retaining an impression of the contour of the undersurface of the other of the person's feet;

said holding means is operable for holding a pair of blanks corresponding to the person's feet in side-by-side relationship; and said drive means is operable for automatically driving the sensing and shaping means both laterally and to-and-fro across each impression and each blank to automatically form a pair of custom-made shoe inserts from the pair of blanks.

16. A system as in claim 15 including switching means for controlling operation of the drive means to automatically drive a sensing portion of the sensing and shaping means both laterally and to-and-fro across each impression and to simultaneously automatically drive a shaping portion of the sensing and shaping means both laterally and to-and-fro across each blank.

17. A system as in claim 16 wherein:

said sensing portion includes arm means having sensor means mounted at one end thereof for sensing the contour of each impression;

said shaping portion includes additional arm means having cutting means mounted at one end thereof for removing material from each blank in accordance with the sensed contour of the corresponding impression; and said sensing and shaping means includes a mounting portion disposed at the other end of each arm means for pivotally supporting the arm means in laterally spaced relationship with the sensing means adjacent to the impression means and the cutting means adjacent to the holding means.

18. A system as in claim 17 wherein:

said first-mentioned arm means comprises a first arm;

said sensor means comprises a roller rotatably mounted on the first arm for successively contacting each impression and following the contour thereof;

said second-mentioned arm means comprises a second arm; and said cutting means comprises a hemispherical cutter mounted on the second arm and rotatably driven for successively removing material from each blank in accordance with the sensed contour of the corresponding impression.

19. A system as in claim 1 wherein said impression means includes:

a housing having a rectangular opening therein;

an array of pin elements disposed in contiguous rows and columns and supported within the housing in the rectangular opening for movement between retracted and extended positions;

control means disposed within the housing for yieldably urging the array of pin elements to an extended position against the undersurface of the person's foot to form an impression of the contour of the undersurface of the person's foot; and locking means for locking the array of pin elements in the extended position to retain the impression of the contour of the undersurface of the person's foot.

20. A system as in claim 19 wherein:

each column of said array of pin elements is separate from each adjoining column by an elongated spacing member disposed lengthwise of the rectangular opening and fixedly mounted within the housing at one end of the rectangular opening; and each pin element of each column of said array of pin elements is disposed in slidable abutting relationship with each adjoining pin element of the same column.

21. A system as in claim 20 wherein said locking means is mounted within the housing adjacent to the oppositely-facing end of the rectangular opening for applying a locking force to each column of the array of pin elements.

22. A system as in claim 21 wherein said locking means includes:

a locking member slidably mounted within the housing adjacent to the last-mentioned end of the rectangular opening for movement between a retracted position out of locking engagement with the array of pin elements and an extended position in locking engagement with the array of pin elements; and a cam member rotatably mounted within the housing and coupled to the locking member for moving the locking member between its retracted and extended positions.

23. A system as in claim 22 wherein said locking means includes:

a cam follower member slidably mounted within the housing, coupled to the cam member, and resiliently and universally coupled to the locking member for moving the locking member between its retracted and extended positions as the cam member is rotated; and control means coupled to the cam member for rotating the cam member in one sense to move the locking member to its retracted position and in the opposite sense to move the locking member to its extended position.

24. A system as in claim 20 wherein:

said control means comprises an inflatable diaphragm disposed within the housing between the array of pin elements and an interior portion of the housing; and said impression means includes retaining means disposed within the housing outside and around the outer periphery of the array of pin elements for holding the inflatable diaphragm in place.

25. A system as in claim 1 wherein said impression means includes:

a housing having first and second rectangular openings disposed therein in side-by-side relationship;

first and second arrays of pin elements, each disposed in contiguous rows and columns and supported within the housing in a corresponding different one of the rectangular openings for movement between retracted and extended positions;

control means disposed within the housing for yieldably urging each array of pin elements to an extended position against the undersurface of a corresponding different one of the person's feet to form an impression of the contour of the undersurface of each of the person's feet; and locking means for locking each array of pin elements in the extended position to retain the impression of the contour of the undersurface of the corresponding one of the person's feet.

26. A system as in claim 25 wherein:

each column of each of said arrays of pin elements is separated from each adjoining column by an elongated spacing member disposed lengthwise of the corresponding rectangular opening and fixedly mounted within the housing at one end of the corresponding rectangular opening;

each pin element of each column of each of said arrays of pin elements is disposed in slidable abutting relationship with each adjoining pin element of the same column; and said locking means is mounted within the housing adjacent to the oppositely-facing end of each rectangular opening for applying a locking force to each column of each array of pin elements.

27. A system as in claim 26 wherein said locking means includes:

first and second locking members, each slidably mounted within the housing adjacent to the last-mentioned end of a corresponding different one of the rectangular openings for movement between a retracted position out of locking engagement with the corresponding array of pin elements and an extended position in locking engagement with the corresponding array of pin elements;

first and second cam members, each rotatably mounted within the housing and coupled to a corresponding different one of the locking members for moving the corresponding locking member between its retracted and extended positions; and first and second control means, each coupled to a corresponding different one of the cam members for rotating the corresponding cam member in one sense to move the corresponding locking member to its retracted position and in the opposite sense to move the corresponding locking member to its extended position.

28. A system as in claim 26 wherein:

said control means comprises an inflatable diaphragm disposed within the housing between each array of pin elements and an interior portion of the housing; and said impression means includes retaining means disposed within the housing outside and around the outer periphery of each array of pin elements for holding the inflatable diaphram in place.

* * * * *